US010208432B2

(12) United States Patent
Seyrlehner

(10) Patent No.: US 10,208,432 B2
(45) Date of Patent: Feb. 19, 2019

(54) TAMPING UNIT FOR TAMPING SLEEPERS OF A TRACK

(71) Applicant: Plasser & Theurer Export von Bahnbaumaschinen Gesellschaft m.b.H., Vienna (AT)

(72) Inventor: Georg Seyrlehner, Chesapeake, VA (US)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 69 days.

(21) Appl. No.: 15/506,571

(22) PCT Filed: Sep. 24, 2015

(86) PCT No.: PCT/EP2015/001893
§ 371 (c)(1),
(2) Date: Feb. 24, 2017

(87) PCT Pub. No.: WO2016/058667
PCT Pub. Date: Apr. 21, 2016

(65) Prior Publication Data

US 2017/0275828 A1 Sep. 28, 2017

(30) Foreign Application Priority Data

Oct. 17, 2014 (AT) ..... GM365/2014

(51) Int. Cl.
*B06B 1/18* (2006.01)
*E01B 27/16* (2006.01)
*E01B 27/17* (2006.01)

(52) U.S. Cl.
CPC ..... *E01B 27/17* (2013.01); *B06B 1/18* (2013.01); *E01B 27/16* (2013.01)

(58) Field of Classification Search
CPC ..... E01B 27/16; E01B 27/17; B06B 1/18
See application file for complete search history.

(56) References Cited

U.S. PATENT DOCUMENTS 3,357,366 A * 12/1967 Plasser ..... E01B 27/16 104/12
3,981,247 A * 9/1976 Theurer ..... E01B 27/16 104/12

(Continued)

FOREIGN PATENT DOCUMENTS

AT 339 358 B 10/1977
AT 513 973 A4 9/2014

(Continued)

OTHER PUBLICATIONS

International Search Report of PCT/EP2015/001893, dated Dec. 4, 2015.

*Primary Examiner* — Jason C Smith
(74) *Attorney, Agent, or Firm* — Collard & Roe, P.C.

(57) ABSTRACT

In a tamping unit for tamping sleepers of a track, both squeezing drives of a tamping tine pair are articulatedly connected to a common connecting carrier. A vibration exciter fastened to the tine carrier is connected to the connecting carrier, likewise fastened to the tine carrier, for transmission of tamping tine vibrations from the connecting carrier to the squeezing drives and the tamping tines.

9 Claims, 3 Drawing Sheets

(56) References Cited

U.S. PATENT DOCUMENTS

Figure 2:
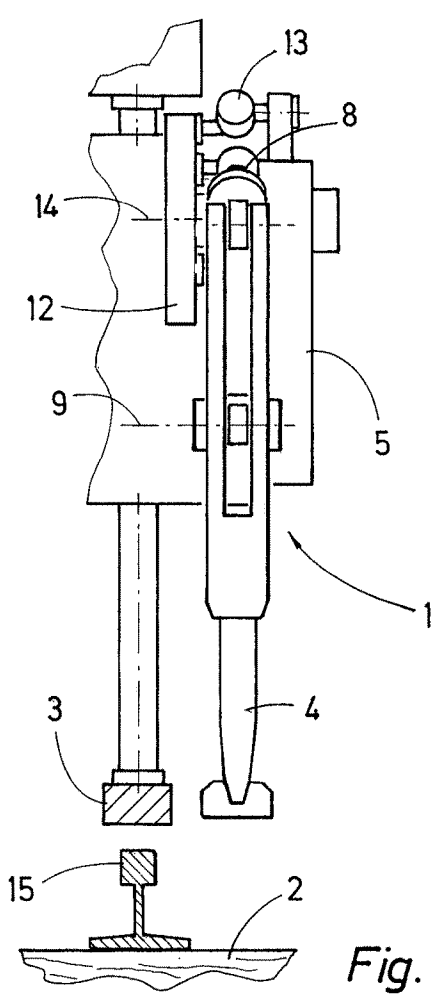

| | | | | | |
|---|---|---|---|---|---|
| 4,068,595 | A * | 1/1978 | Weber | B06B 1/18 | 104/12 |
| 4,240,352 | A * | 12/1980 | Theurer | E01B 27/16 | 104/12 |
| 4,744,303 | A * | 5/1988 | Pasquini | E01B 27/16 | 104/12 |
| 4,942,821 | A * | 7/1990 | Rossanigo | E01B 27/16 | 104/12 |
| 5,706,734 | A * | 1/1998 | Theuerer | E01B 27/17 | 104/12 |
| 6,389,979 | B1 * | 5/2002 | Theurer | E01B 27/16 | 104/10 |
| 2016/0010287 | A1 * | 1/2016 | Lichtberger | E01B 27/16 | 104/10 |
| 2017/0275828 | A1 * | 9/2017 | Seyrlehner | B06B 1/18 | |

FOREIGN PATENT DOCUMENTS

| | | | |
|---|---|---|---|
| CH | 470 536 | A | 3/1969 |
| CH | 658 689 | A5 | 11/1986 |
| CN | 103850157 | A | 6/2014 |
| EP | 0 331 956 | A2 | 9/1989 |
| EP | 0 775 779 | A1 | 5/1997 |
| GB | 2 451 310 | A | 1/2009 |

* cited by examiner

Fig. 6
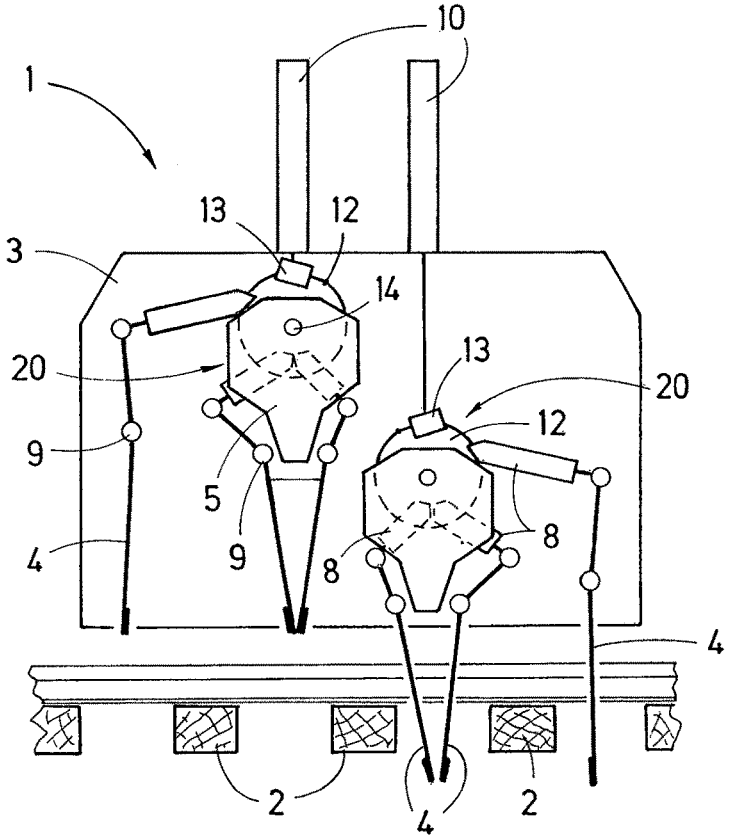
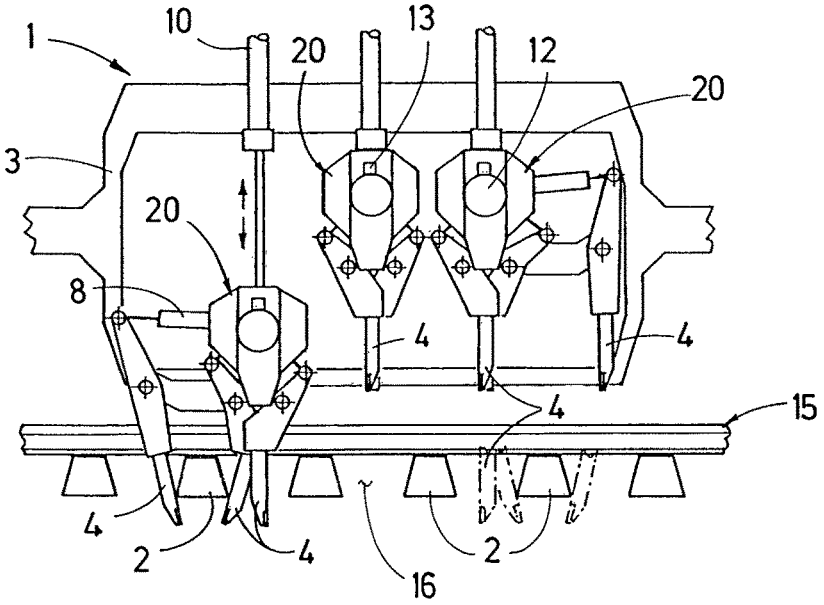
Fig. 7

TAMPING UNIT FOR TAMPING SLEEPERS OF A TRACK

CROSS REFERENCE TO RELATED APPLICATIONS

This application is the National Stage of PCT/EP2015/001893 filed on Sep. 24, 2015, which claims priority under 35U.S.C. § 119 of Austrian Application No. GM 365/2014 filed on Oct. 17, 2014, the disclosures of which are incorporated by reference. The international application under PCT article 21(2) was not published in English.

The invention relates to a tamping unit for tamping sleepers of a track, including a tine carrier mounted for vertical adjustment on an assembly frame and connected to tamping tines, wherein the tamping tines which are mounted on the tine carrier for pivoting towards one another in pairs and form a tamping tine pair are each connected to a hydraulic squeezing drive and are designed to be set into tamping tine vibrations by means of a vibration exciter.

Tamping units for tamping sleepers of a track are already widely known, such as, for example, from U.S. Pat. No. 4,240,352, AT 339 358, EP 0 331 956 or U.S. Pat. No. 4,068,595. A rotatable eccentric shaft serves as vibration exciter, with the squeezing drives for transmission of the vibrations to the tamping tines being articulatedly connected to said shaft.

Alternatively, the vibration exciter can also be configured as a combination of a linear squeezing drive and a hydraulic vibration drive integrated into the former (AT 339 358, EP 0 331 956 or AT 513 973). To that end, the squeezing drives equipped with displacement transducers are activated by means of corresponding servo valves of a hydraulic system. Thus, the squeezing speed, the vibration amplitude, the form thereof, and the frequency can be pre-set.

It is the object of the present invention to provide a tamping unit of the specified kind with which the tamping tine vibrations can be produced in a simplified manner.

According to the invention, this object is achieved with a tamping unit of the specified type by way of the features cited in the characterizing part of the main claims.

This kind of structural design of vibration transmission to the tamping tines has the particular advantage that it is possible with only one vibration exciter to transmit the vibrations via the connecting carrier to at least two squeezing drives. In this manner, it is possible to reduce the number of the vibration exciters, which are subjected to very high stress, as well as the structural expense. Additionally, it is possible to achieve an exact vibration synchronisation. The function of the squeezing drives which are also subjected to high stress can be reduced to the linear squeezing motion for the tamping movement of the tamping tines.

Additional advantages of the invention become apparent from the further claims and the drawing description.

The invention will be described in more detail below with reference to an embodiment represented in the drawing.

Figure 1:
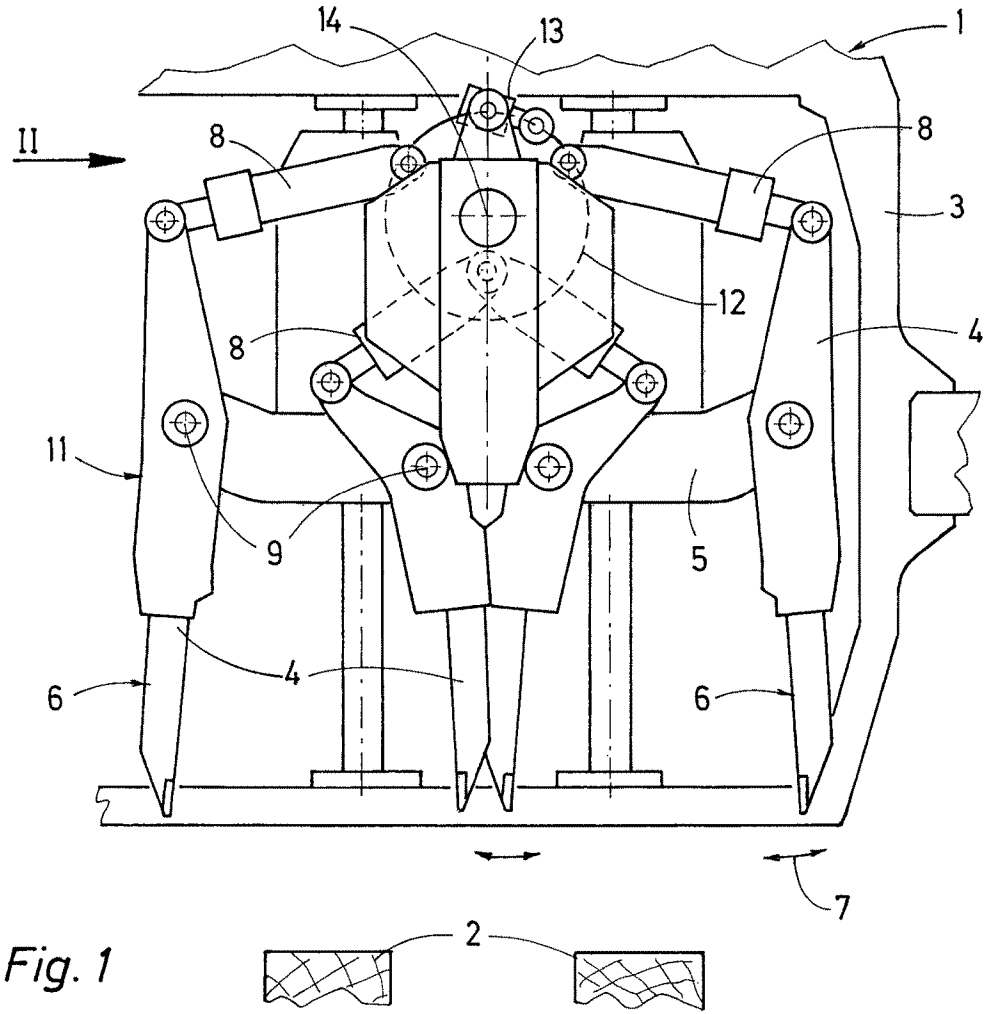

FIG. 1 shows a side view of a tamping unit for simultaneously tamping two sleepers of a track, FIG. 2 shows a view of the tamping unit in the longitudinal direction of the rails according to arrow II, FIGS. 3 to 7 show further variants of a tamping unit according to the invention.

A tamping unit 1, shown in FIGS. 1 and 2, for the simultaneous tamping of two sleepers 2 of a track has a tine carrier 5 which is mounted for vertical adjustment on an assembly frame 3 and connected to a total of four tamping tines 4 arranged one behind the other. The tamping tines 4, forming a tamping tine pair 6 in each case, are mounted on the tine carrier 5 for pivoting in pairs towards one another about a pivot axis 9. For executing this squeezing motion (arrow 7), each tamping tine 4 is connected to a hydraulic squeezing drive 8. The tine carrier 5 is mounted on the assembly frame 3 for vertical adjustment by means of drives 10 (FIG. 6).

Strictly speaking, each tamping tine 4 provided for immersion into ballast of the track is fastened on a tamping lever 11 which is mounted on the tine carrier 5 and connected to the squeezing drive 8. For the sake of simplicity, however, merely the expression "tamping tine" will be used in the following for this lever assembly pivotable about the pivot axis 9.

The total of four squeezing drives 8 of both tamping tine pairs 6 are articulatedly connected to a common connecting carrier 12. A vibration exciter 13 fastened to the tine carrier 5 is connected to the connecting carrier 12 for transmission of tamping tine vibrations from the connecting carrier 12 to the corresponding squeezing drives 8 and the tamping tines 4 linked thereto.

The connecting carrier 12, which is designed approximately disk-shaped in the example shown, is mounted on the tine carrier 5 for rotation about an axis of rotation 14 extending parallel to the pivot axes 9 of the tamping tines 4, and the vibration exciter 13, configured as a hydraulic linear motor, is provided for a slight cyclic rotation or vibration of the connecting carrier 12 about the axis of rotation 14.

The vibration of the connecting carrier 12 produced by the vibration exciter 13 is transmitted in further sequence to all of the linked squeezing drives 8 and from these to the corresponding tamping tines 4 (the ideal tamping tine frequency for tamping is 35 Hz). By appropriately regulating/controlling the hydraulic vibration exciter 13, it is possible to quickly change various tamping parameters, such as the vibration frequency, the vibration amplitude, and also the duration of the vibration. Thus, a tamping cycle intended for the tamping of the two sleepers 2 can be optimally adapted to the particular ballast conditions. Additionally, as already described by EP 1 653 003, a tamping cycle can also be composed of several sequences, each having different tamping parameters.

As a result of the interposition, according to the invention, of a connecting carrier 12 between the vibration exciter 13 and the squeezing drives 8, a significant simplification of the structural expense can be achieved, since merely a single vibration exciter 13 is required for four squeezing drives 8. Furthermore, by suitable positioning of the articulation points of the squeezing drives 8 on the connecting carrier 12, an exact synchronisation of the tamping tine vibrations is possible.

As visible in FIG. 2, the expression tamping tines 4 of a tamping unit 1 always refers to the tamping tines 4 mounted on a tamping tine carrier 12 and designed for immersion on one longitudinal side of a rail 15 of a track. As is well known, the tamping tines 4 designed for immersion on the other longitudinal side of the rail 15 can be mounted on separate tine carriers 5, resulting in two independently vertically and transversely displaceable tamping units (split-head). Alternatively, however, these two tamping units 1 can also be connected into a single tamping unit.

Figure 3:
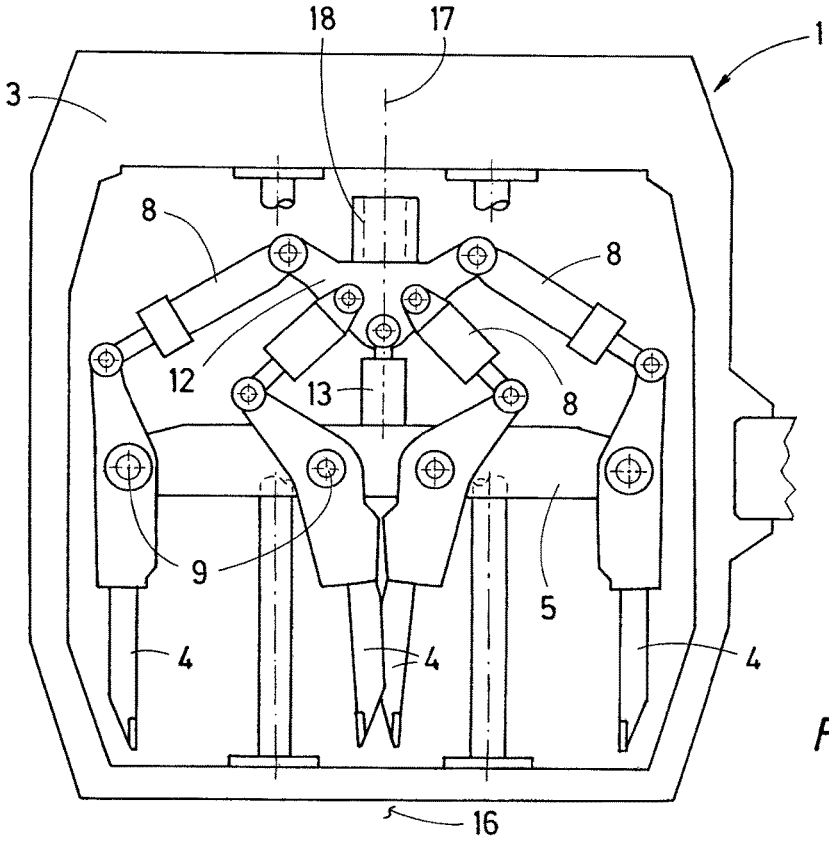

A variant of a tamping unit 1 shown in FIG. 3 differs with regard to the just-described tamping unit 1 to the effect that the vibration exciter 13, designed as a hydraulic linear motor, is arranged in the middle between the two central tamping tines 4 provided for immersion into a common sleeper crib 16 and has a lifting axis 17 extending parallel to a direction of vertical adjustment of the tamping unit 1.

The connecting carrier 12 connected to four squeezing drives 8 is mounted in a vertical guide 18, fastened to the tine carrier 5, for adjustment in the lifting axis 17 relative to the tine carrier 5. A cyclic vibrating motion of the vibration exciter 13 along the lifting axis 17 is here also transmitted to the connecting carrier 12 and from there to the four squeezing drives 8 and in further sequence to the tamping tines 4.

Figure 4:
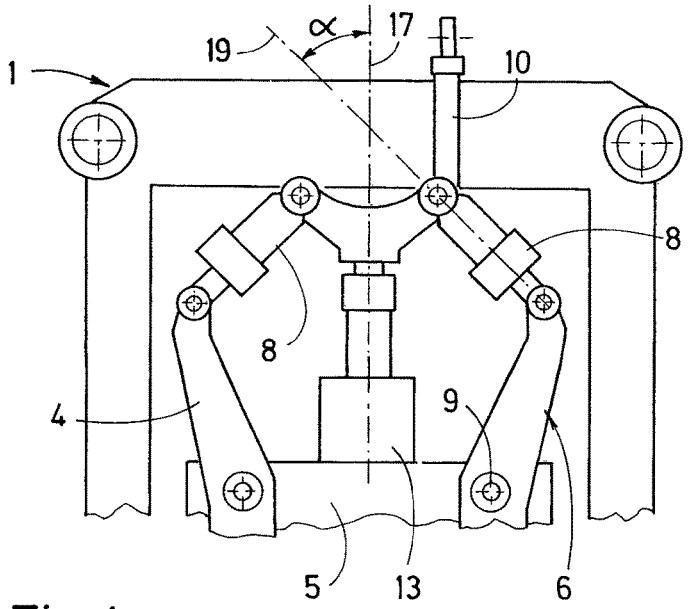

A tamping unit 1 shown partially in FIG. 4 has two tamping tines 4, squeezable towards one another by means of the squeezing drives 8, for tamping a single sleeper. The vibration exciter 13, designed as a hydraulic linear motor and fastened to the tine carrier 5, is arranged centrally between the two tamping tines 4 of the tamping tine pair 6 and has a lifting axis 17 extending parallel to a direction of vertical adjustment of the tamping unit 1. A longitudinal axis 19 of each squeezing drive 8 encloses an angle $\alpha$ of about 40 to 50 degrees, preferably 45 degrees, with the lifting axis 17.

Figure 5:
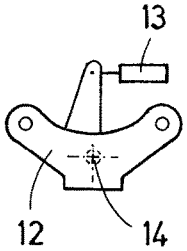

As can be seen in the schematic representation in FIG. 5, the connecting carrier 12 of the tamping unit 1 described with reference to FIG. 4 could alternatively also be mounted on the tine carrier 5 for rotation about an axis of rotation 14 and connected to the vibration exciter 13.

A tamping unit 1 shown schematically in FIG. 6 is designed for simultaneously tamping three sleepers 2 and is composed—as seen in a direction extending perpendicularly to the pivot axis 9—of two similarly designed tamping unit components 20. Each of these has three tamping tines 4 which are articulatedly connected to a common connecting carrier 12. Each of the two connecting carriers 12, which are independent of one another, is mounted on the respective tine carrier 5 for rotation about an axis of rotation 14 in each case and connected to a vibration exciter 13 for producing the tamping tine vibrations. In case an obstacle to tamping is present, it is possible to selectively lower for the tamping operation only the tamping unit component 20 which is not located above the obstacle. In this case, the vibration exciter 13 of the tamping unit component 20 which is not lowered would be switched non-operational,so that no vibrations are produced.

In FIG. 7, a tamping unit 1 for the simultaneous tamping of four sleepers 2 is shown which is known in principle already from U.S. Pat. No. 6,389,979. Like the tamping unit 1 described with reference to FIG. 6, this tamping unit is composed of two tamping unit components 20 which are of similar design and arranged one behind the other. However, a third tamping unit component 20 having two tamping tines intended for immersion into the same sleeper crib 16 is located between the former. Now, according to the invention, each of the three tamping unit components 20 is equipped with a connecting carrier 12 mounted on the respective tine carrier 5 for rotation about the axis of rotation 14, wherein a separate vibration exciter 13 is associated with each connecting carrier 12.

Instead of the above-described hydraulic linear motors, the vibration exciters could also, of course, produce the vibrations acting on the connecting carrier 12 or the tamping tines in a different known manner, for example electrodynamically.

The invention claimed is:

1. A tamping unit for tamping sleepers of a track, comprising:

an assembly frame;

a plurality of tamping tines;

a tine carrier mounted for vertical adjustment on said assembly frame and connected to said plurality of tamping tines, wherein tamping tines which are mounted on the tine carrier for pivoting towards one another in pairs form a tamping tine pair;

a hydraulic squeezing drive coupled to said plurality of tamping tines;

a vibration exciter which is designed to set said plurality of tamping tines into tamping tine vibrations, a common connecting carrier wherein said hydraulic squeezing drives of a tamping tine pair of said plurality of tamping tines are articulatedly connected to said common connecting carrier, wherein the vibration exciter fastened to the tine carrier is connected to the common connecting carrier for transmission of the tamping tine vibrations from the common connecting carrier to the hydraulic squeezing drives and to the plurality of tamping tines.

2. The tamping unit according to claim 1, wherein the vibration exciter, designed as a hydraulic linear motor, is arranged centrally between two tamping tines of said plurality of tamping tines of the tamping tine pair and has a lifting axis extending parallel to a direction of vertical adjustment of the tamping unit.

3. The tamping unit according to claim 1, wherein the common connecting carrier is mounted on the tine carrier for rotation about an axis of rotation extending parallel to pivot axes of the plurality of tamping tines, and the vibration exciter is provided for rotation of the common connecting carrier about the axis of rotation.

4. The tamping unit according to claim 2, wherein a longitudinal axis of each squeezing drive encloses an angle $\alpha$ of about 40 to 50 degrees, preferably 45 degrees, with the lifting axis.

5. A tamping unit for simultaneously tamping two sleepers of a track, comprising:

an assembly frame;

a hydraulic squeezing drive;

a common connecting carrier;

a vibration exciter;

a tine carrier mounted for vertical adjustment on said assembly frame;

a plurality of tamping tines coupled to said tine carrier, said plurality of tamping tines arranged one behind the other, wherein the plurality of tamping tines are mounted on the tine carrier for pivoting towards one another in pairs about a pivot axis and form a tamping tine pair in each case are each connected to said hydraulic squeezing drive and are designed to be set into tamping tine vibrations by means of a vibration exciter, wherein:

said hydraulic squeezing drives of both tamping tine pairs are articulatedly connected to a said common connecting carrier, said vibration exciter, fastened to the tine carrier, is connected to the common connecting carrier for transmission of the tamping tine vibrations from the common connecting carrier to the squeezing drives and to the plurality of tamping tines.

6. The tamping unit according to claim 5, wherein the vibration exciter, designed as a hydraulic linear motor, is arranged centrally between the two central tamping tines of the plurality of tamping tines provided for immersion into a common sleeper crib and has a lifting axis extending parallel to a direction of vertical adjustment of the tamping unit.

7. The tamping unit according to claim 5, wherein the common connecting carrier is mounted in a vertical guide, fastened to the tine carrier, for adjustment in the lifting axis relative to the tine carrier.

8. The tamping unit according to claim 5, wherein the common connecting carrier is mounted on the tine carrier for rotation about an axis of rotation extending parallel to the pivot axes of the plurality of tamping tines, and the vibration exciter is provided for a rotation of the common connecting carrier about the axis of rotation.

9. A tamping unit for simultaneously tamping at least three sleepers of a track, comprising:

an assembly frame;

a plurality of hydraulic squeezing drives;

a vibration exciter;

a plurality of tine carriers which are vertically adjustable independently of one another and mounted for vertical adjustment on said assembly frame;

a plurality of tamping tines coupled to said plurality of tine carriers, said plurality of tine carries arranged one behind the other, wherein the plurality of tamping tines which are mounted on the tine carrier for pivoting about a pivot axis are each connected to at least one of said plurality of hydraulic squeezing drives and are designed to be set into tamping tine vibrations by means of said vibration exciter, wherein:

a) the squeezing drives of all of the plurality of tamping tines mounted on a common tine carrier are articulatedly connected to a common connecting carrier, b) each common connecting carrier is connected to a vibration exciter, fastened to the tine carrier, for transmission of the tamping tine vibrations from the common connecting carrier to the squeezing drives and to the plurality of tamping tines.

* * * * *